US010248050B2

(12) United States Patent
Akita et al.

(10) Patent No.: US 10,248,050 B2
(45) Date of Patent: Apr. 2, 2019

(54) DEVELOPING DEVICE HAVING MAGNETIC SEALING MEMBERS

(71) Applicant: CANON KABUSHIKI KAISHA, Tokyo (JP)

(72) Inventors: Masanori Akita, Toride (JP); Yushi Sadamitsu, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/353,008

(22) Filed: Nov. 16, 2016

(65) Prior Publication Data

US 2017/0068188 A1 Mar. 9, 2017

Related U.S. Application Data

(63) Continuation of application No. PCT/JP2015/065488, filed on May 22, 2015.

(30) Foreign Application Priority Data

May 23, 2014 (JP) ..... 2014-107606

(51) Int. Cl.
*G03G 15/08* (2006.01)
*G03G 15/09* (2006.01)

(52) U.S. Cl.
CPC ..... *G03G 15/0921* (2013.01); *G03G 15/08* (2013.01); *G03G 15/0942* (2013.01); *G03G 15/0893* (2013.01)

(58) Field of Classification Search
CPC ..... G03G 15/0921; G03G 15/08
(Continued)

(56) References Cited

U.S. PATENT DOCUMENTS 5,202,729 A * 4/1993 Miyamoto ..... G03G 15/0928 399/103
5,267,007 A 11/1993 Watanabe et al.
(Continued)

FOREIGN PATENT DOCUMENTS

EP 0 821 288 A1 1/1998
JP H03-13975 A 1/1991
(Continued)

OTHER PUBLICATIONS

PCT International Search Report and the Written Opinion dated Aug. 18, 2015, in PCT/JP2015/065488.
(Continued)

*Primary Examiner* — Susan S Lee
(74) *Attorney, Agent, or Firm* — Venable LLP

(57) ABSTRACT

A developing device includes a developing container, a rotatable developer carrying member, and a magnetic field generator. Magnetic members are provided at end portions of the developer carrying member with a gap to an outer peripheral surface of the developer carrying member, and magnet members are provided opposed to the magnetic members so as to magnetize the magnetic members. The outer peripheral surface of the developer carrying member includes a first region including a developing region corresponding to an image forming region and a second region outside and adjacent to the first region and having lower developer feeding power than the first region or having substantially no feeding power. The first region is larger than a region between outside surfaces of the magnetic members and is smaller than a region between inside surfaces of the magnet members.

24 Claims, 6 Drawing Sheets

(58) Field of Classification Search
USPC ..... 399/277, 104
See application file for complete search history.

(56) References Cited

U.S. PATENT DOCUMENTS

| | | | | |
|---|---|---|---|---|
| 6,160,976 | A | 12/2000 | Karakama et al. | |
| 6,640,076 | B2 | 10/2003 | Shintani | |
| 7,561,838 | B2 | 7/2009 | Sakamaki et al. | |
| 7,725,061 | B2 | 5/2010 | Sakamaki et al. | |
| 7,826,757 | B2 | 11/2010 | Akita | |
| 8,811,854 | B2 | 8/2014 | Nose | |
| 9,020,403 | B2 | 4/2015 | Noguchi et al. | |
| 9,304,446 | B2 | 4/2016 | Akita et al. | |
| 2013/0129376 | A1 | 5/2013 | Noguchi | |
| 2014/0178094 | A1* | 6/2014 | Kanai ..... | G03G 15/0817 399/104 |
| 2015/0234323 | A1 | 8/2015 | Furukawa et al. | |

FOREIGN PATENT DOCUMENTS

| | | | |
|---|---|---|---|
| JP | 09325617 | A * | 12/1997 |
| JP | H10-39630 | A | 2/1998 |
| JP | 09-218583 | A | 8/1998 |
| JP | 11-52731 | A | 2/1999 |
| JP | 2892456 | B2 | 5/1999 |
| JP | 2002-229336 | A | 8/2002 |
| JP | 2007-72222 | A | 3/2007 |
| JP | 2009-151012 | A | 7/2009 |
| JP | 2011-232536 | A | 11/2011 |
| JP | 2013-15702 | A | 1/2013 |
| JP | 2013-50526 | A | 3/2013 |
| JP | 2013-050526 | A | 3/2013 |
| RU | 1788510 | A1 | 1/1993 |
| RU | 2501058 | C2 | 12/2013 |

OTHER PUBLICATIONS

Korean Office Action dated Dec. 13, 2017, in related Korean Patent Application No. 10-2016-7035133.
Russian Notice of Allowance dated Jan. 30, 2018, and Search Report in related Russian Patent Application No. 2016150541.
European Search Report dated Mar. 2, 2018, in related European Patent Application No. 15795692.1.

* cited by examiner

DEVELOPING DEVICE HAVING MAGNETIC SEALING MEMBERS

This application is a continuation of PCT Application No. PCT/JP2015/065488, filed on May 22, 2015.

TECHNICAL FIELD

The present invention relates to a developing device and a process cartridge which are usable in an image forming apparatus of an electrophotographic type or an electrostatic recording type, and relates to the image forming apparatus.

BACKGROUND ART

Conventionally, in the developing device used in the image forming apparatus of the electrophotographic type or the like, as a developer carrying member for feeding the developer while carrying the developer, a rotatable developing sleeve is used in many cases. At each of end portions of this developing sleeve with respect to an axial direction of the developing sleeve, a sealing member for suppressing flowing-out of the developer from a developing container is provided.

As this sealing member, an elastic member such as felt or a foam rubber is used in many cases. On the other hand, in the case where a developer having a magnetic property is used, there is a method in which a magnetic sealing member which is the sealing member formed with a magnetic member is positioned with a certain gap to an outer peripheral surface of the developing sleeve and the flowing-out of the developer from the developing container is suppressed by this magnetic sealing member. Incidentally, the developer having the magnetic property is a one-component developer (toner) in some cases, and is a two-component developer containing a non-magnetic toner and a means carrier.

The magnetic sealing member is constituted using a magnet. Further, at each of the end portions of the developing sleeve with respect to the axial direction of the developing sleeve, the magnetic sealing member extends so as to oppose a predetermined range of the developing sleeve with respect to a circumferential direction of the developing sleeve with the certain gap to the outer peripheral surface of the developing sleeve, and in this state, is mounted together with the developing sleeve to the developing container. The magnetic sealing member closes the gap between the outer peripheral surface of the developing sleeve and the surface thereof by a magnetic brush formed by erection of a chain of the developer formed along each of magnetic lines of force, and suppresses the flowing-out of the developer from the developing container.

The magnetic sealing member is in non-control with the developing sleeve, and therefore, a rotational torque of the developing sleeve becomes very small, and accordingly, it becomes possible to make a driving motor small in size and low in price. Further, also a fluctuation in rotational torque becomes small, so that rotation non-uniformity of the developing sleeve and a photosensitive drum does not readily generate, and therefore it is possible to suppress a lowering in image quality due to the rotation non-uniformity. Further, the magnetic sealing member is not deteriorated by abrasion or the like, and therefore can be used for a long term and not only contributes to lifetime extension but also is capable of meeting recycling.

Here, Japanese Laid-Open Patent Application Hei 10-39630 discloses that a magnetic sealing member is constituted by a magnet and a magnetic member and diffusion of magnetic lines of force for sealing a gap between the magnetic sealing member and a developing sleeve, in an axial direction of the developing sleeve, and a sealing property of the magnetic sealing member is improved.

SUMMARY OF THE INVENTION

Problem to be Solved by the Invention

However, for example, in the case where the sealing property of the magnetic sealing member is enhanced by a manner as described above in JP-H Hei 10-39630, it turned out that the following phenomenon generated in some cases. That is, in the case where the developer feeding power of the developing sleeve is lower than the sealing property of the magnetic sealing member, the developer stagnates in some cases at a taking-in portion where the developer passed through a developing portion (developing position) by being fed by the developing sleeve is taken in the developing container again. As a result, the developer cannot be satisfactorily fed to an inside of the developing container, so that a phenomenon that the developer flows out to an outside of the developing container (herein, this phenomenon is referred to as "developer dropping") generates in some cases.

On the other hand, in order to suppress the stagnation of the developer at the taking-in portion as described above, in the case where the developer feeding power by the developing sleeve is enhanced, the developer confined by magnetic lines of force of the magnetic sealing member is deteriorated by sliding with the developing sleeve in some cases. As a result, for example, in the case of the two-component developer, a phenomenon that a toner component is liberated and an accumulated toner flows out to an outside of the developing container (herein, this phenomenon is referred to as "toner dropping") generates in some cases.

Accordingly, an object of the present invention is to provide a developing device, a process cartridge and an image forming apparatus which are capable of suppressing inconveniences such as stagnation of the developer at the taking-in portion of the developer and deterioration of the developer due to sliding of the developer with the developer carrying member in the case where the magnetic sealing members are used.

Means for Solving the Problem

The above object is accomplished by the developing device, the process cartridge and the image forming apparatus according to the present invention. In summary, the present invention is a developing device comprising: a developing container configured to accommodate a developer; a rotatable developer carrying member configured to carry and feed the developer to an image bearing member; magnetic field generating means provided inside the developer carrying member and configured to generate a magnetic field; magnetic sealing members provided at end portions, respectively, of the developer carrying member with respect to an axial direction of the developer carrying member with a gap to an outer peripheral surface of the developer carrying member; and magnetic members provided inside the magnetic sealing members with respect to the axial direction of the developer carrying member at the end portions, respectively, with respect to the axial direction of the developer carrying member with a gap to the outer peripheral surface of the developer carrying member and with a gap to the magnetic sealing members, wherein with respect to the axial direction of the developer carrying member, the outer peripheral surface of the developer carrying member includes a first region including a developing region corresponding to an image forming region on the image bearing member and a second region outside and adjacent to the first region and having lower developer feeding powder than in the first region or having substantially no feeding power, and wherein a boundary between the first region and the second region of the outer peripheral surface of the developer carrying member at each of the end portions of the developer carrying member with respect to the axial direction of the developer carrying member is positioned between the magnetic sealing member and the magnetic member with respect to the axial direction of the developer carrying member.

According to another aspect of the present invention, there is provided a process cartridge including an electrophotographic photosensitive member and the above developing device, of the present invention, for developing an electrostatic latent image formed on the electrophotographic photosensitive member and detachably mountable to an apparatus main assembly of an image forming apparatus.

According to a further aspect of the present invention, there is provided an image forming apparatus including an image bearing member and the above developing device, of the present invention, for developing an electrostatic latent image formed on the image bearing member.

Effect of the Invention

According to the present invention, it is possible to suppress the inconvenience such as stagnation of the developer at the taking-in portion of the developer and deterioration of the developer due to the sliding of the developer with the developer carrying member in the case where the magnetic sealing members are used.

EMBODIMENTS FOR CARRYING OUT THE INVENTION

In the following, a developing device, a process cartridge and an image forming apparatus according to the present invention will be described in further detail in accordance with the drawings.

Embodiment 1

1. General Structure and Operation of Image Forming Apparatus

Figure 1:
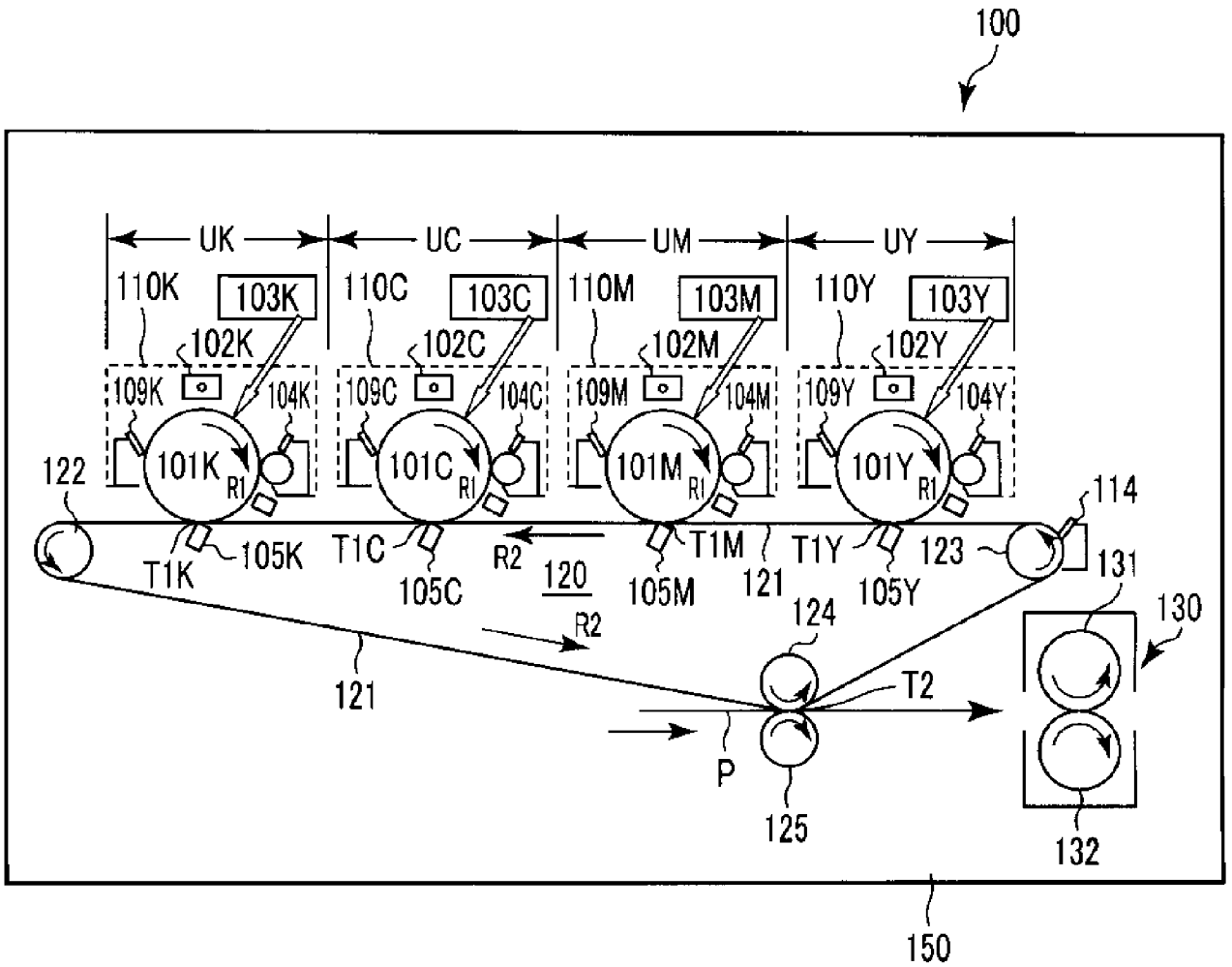
FIG. 1 is a schematic sectional view of an image forming apparatus.

First, a general structure and operation of the image forming apparatus according to an embodiment of the present invention will be described. FIG. 1 is a schematic sectional view of an image forming apparatus 100 in this embodiment. The image forming apparatus 100 in this embodiment is a tandem type laser beam printer employing an intermediary transfer type capable of forming of a full-color image by using an electrophotographic type.

The image forming apparatus 100 includes first, second, third and fourth image forming portions UY, UM, UC, UK as a plurality of image forming portions (stations). The respective image forming portions UY, UM, UC, UK form images of respective colors of yellow (Y), magenta (M), cyan (C) and black (K), respectively. In this embodiment, structures and operations of the respective image forming portions UY, UM, UC, UK are substantially the same except that colors of toners used are different. Accordingly, in the following, in the case where there is no need to make distinction in particular, suffixes Y, M, C, K of symbols representing elements of colors are omitted and will be described collectively with respect to the elements.

The image forming portion U includes a photosensitive drum 101 which is a drum-shaped (cylindrical) electrophotographic photosensitive member (photosensitive member) as an image bearing member. The photosensitive drum 101 is rotationally driven in an arrow R1 direction in the figure. A surface of the photosensitive drum 101 is electrically charged uniformly by a charging device 102 as a charging means. In this embodiment, the charging device 102 is of a corona charging type in which non-control charging is made. The surface of the charged photosensitive drum 101 is exposed to light by an exposure device (laser scanner device) 103 as an exposure means. The exposure device 103 is driven by a laser driver (not shown) depending on image information of a component corresponding to the image forming portion U. As a result, an electrostatic latent image (electrostatic image) of the component corresponding to the image forming portion U is formed on the photosensitive drum 101. The electrostatic latent image formed on the photosensitive drum 101 is developed (visualized) as a toner image by a developing device 104 as a developing means. In this embodiment, the developing device 104 develops the electrostatic latent image by supplying the toner charged to the same polarity as a charge polarity of the photosensitive drum 101 to an exposed portion where an absolute value of a potential is lowered by the exposure to light after being uniformly charged. The developing device 104 will be described later in further detail.

Below the respective image forming portion U in the figure, an intermediary transfer device 120 is placed. The intermediary transfer device 120 includes an intermediary transfer belt 121 constituted by an endless belt as an intermediary transfer member. The intermediary transfer belt 121 is stretched by a tension roller 122, a driving roller 123 and a secondary transfer opposite roller 124. The intermediary transfer belt 121 is traveled (rotated) in an arrow R2 direction in the figure by rotationally driving the driving roller 123. On an inner peripheral surface (back surface) side of the intermediary transfer belt 121, at positions opposing the photosensitive drums 101 of the respective image forming portion U primary transfer blade 105 as primary transfer means are disposed. The primary transfer blades 105 are urged (pressed) toward the photosensitive drums 101 via the intermediary transfer belt 121, so that primary transfer portions (primary transfer nips) T1 where the intermediary transfer belt 121 and the photosensitive drums 101 are in contact with each other is formed. Further, on an outer peripheral surface (front surface) side of the intermediary transfer belt, at a position opposing the secondary transfer opposite roller 124, a secondary transfer roller 125 as a secondary transfer means is provided. The secondary transfer roller 125 is urged (pressed) toward the secondary transfer opposite roller 124 via the intermediary transfer belt 121, so that a secondary transfer portion (secondary transfer nip) T2 where the intermediary transfer belt 121 and the secondary transfer roller 125 are in contact with each other is formed. Further, on the outer peripheral surface side of the intermediary transfer belt 121, at a position opposing the driving roller 123, a belt cleaner 114 as an intermediary transfer member cleaning means is provided.

For example, during full-color image formation, on the photosensitive drums 101 of the respective image forming portions U, the toner images of the respective colors of yellow, magenta, cyan and black are formed, respectively. The toner images are successively transferred (primary-transferred) superposedly onto the intermediary transfer belt 121 at the respective primary transfer portions T1 by the action of the primary transfer blades 105. At this time, to the primary transfer blades 105, a primary transfer bias of an opposite polarity to the charge polarity (normal charge polarity: negative polarity in this embodiment) of the toner during development is applied. At the secondary transfer portion T2, the toner images transferred on the intermediary transfer belt 121 are transferred (secondary transferred) electrostatically onto a recording material (recording medium, transfer material) S such as recording paper by the action of the secondary transfer roller 125. At this time, to the secondary transfer roller 125, a secondary transfer bias of an opposite polarity to the charge polarity of the toner during the development is applied.

The recording material S on which the toner images are transferred is fed to a fixing device 130 including fixing rollers 131 and 132, and is heated and pressed by the fixing device 130, so that the toner images are fixed thereon. Thereafter, the recording material S is discharged (outputted) to an outside of an apparatus main assembly 150 of the image forming apparatus 100.

Further, the toners remaining on the photosensitive drum 101 after the primary transfer (primary transfer residual toner) are removed from the photosensitive drums 101 by drum cleaners 109 as photosensitive member cleaning means and are collected. Further, the toner remaining on the intermediary transfer belt 121 after the secondary transfer (secondary transfer residual toner) is removed from the intermediary transfer belt 121 by the belt cleaner 114 and is collected.

In this embodiment, at each image forming portion U, the photosensitive drum 101 and, as process means actable on the photosensitive drum 101, the charging device 102, the developing device 104 and the drum cleaner 109 are integrally assembled into a cartridge and constitute a process cartridge 110. The process cartridge 110 is detachably mountable to the apparatus main assembly 150 of the image forming apparatus 100.

Here, the process cartridge is in general such that the photosensitive member and, as the process means actable on the photosensitive member, at least one of the charging means, the developing means and the cleaning means are integrally assembled into a cartridge, and the cartridge is made detachably mountable to the apparatus main assembly of the image forming apparatus. In the present invention, the process cartridge includes at least the developing device as the developing means. Further, the electrostatic image forming apparatus forms the image on the recording medium by using an electrophotographic image forming process. As the electrophotographic image forming apparatus, for example, an electrophotographic copying machine, an electrophotographic printer (laser beam printer, LED printer or the like), a facsimile device, and a word processor are included. Further, the developing device is mounted in the apparatus main assembly of the image forming apparatus in a state in which the developing device constitutes a part of the process cartridge or alone. The developing device may also be used alone as a cartridge (developing cartridge) detachably mountable to the apparatus main assembly of the image forming apparatus. Further, the apparatus main assembly of the image forming apparatus is an image forming apparatus portion from which the process cartridge or the developing cartridge is removed.

Incidentally, in this embodiment, the drum-shaped photosensitive member was used as the image bearing member, but it is also possible to use a belt-shaped photosensitive member. Also as regards a charging type, a transfer type, a cleaning type and a fixing type, these types are not limited to the above-described types.

2. Developing Device

<Outline of Developing Device>

In this embodiment, structures and operations of the developing devices 104 of the respective image forming portions U are substantially the same except that the colors of the toners used are different from each other, and therefore in the following, description will be made by paying attention to a single image forming portion U. Further, here, with respect to the developing device 104 and elements thereof, a direction substantially parallel to an axial direction of a developer carrying member described later is referred to as a longitudinal direction, and a direction perpendicular to the longitudinal direction is referred to as a widthwise direction in some cases.

Figure 2:
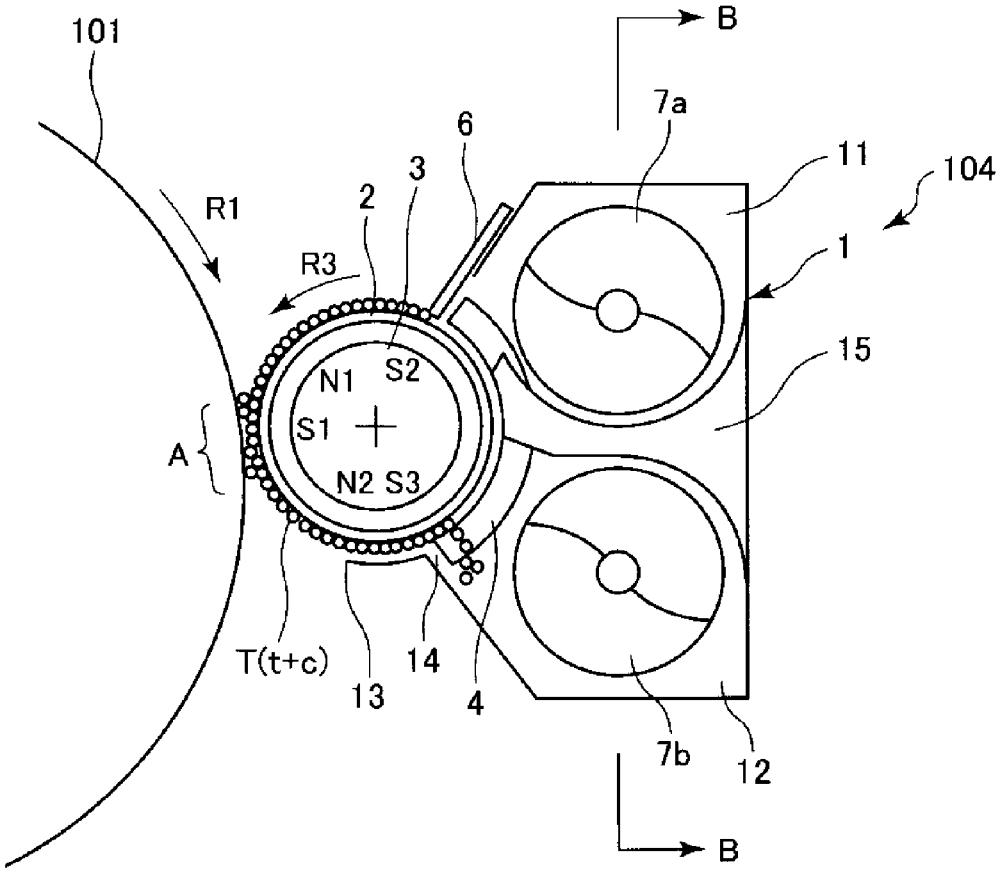
FIG. 2 is a sectional view of a developing device along a widthwise direction.
Figure 3:
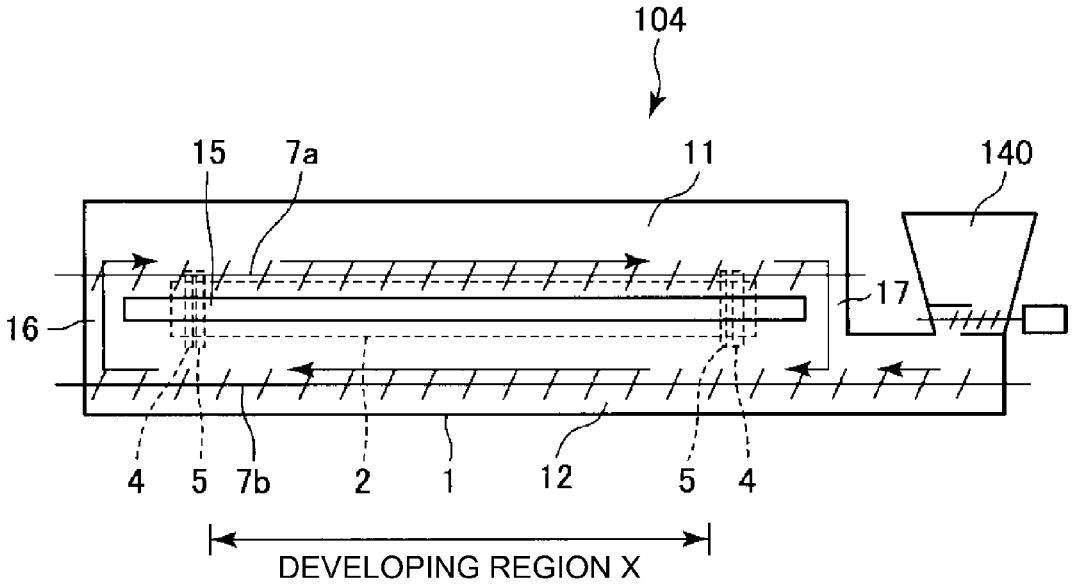
FIG. 3 is a sectional view of the developing device along a longitudinal direction.

FIG. 2 is a sectional view of the developing device 104 along the widthwise direction. FIG. 3 is a sectional view taken along B-B line in FIG. 2 (in which also a part of elements disposed in a front side of the drawing sheet surface relative to the (B-B) cross-section is shown by a broken line). The developing device 104 is a device for visualizing the electrostatic latent image formed on the image bearing member, with the toner. The developing device 104 includes a developing container 1 for accommodating the developer. Further, the developing device 104 includes a developing sleeve 2 as a rotatable developer carrying member for feeding the developer to the image bearing member while carrying the developer. Further, the developing device 104 includes a magnet roller 3 as a magnetic field generating means, placed inside the developing sleeve 2, for generating a magnetic field for carrying the developer on the developing sleeve 2. Further, the developing device 104 includes magnetic seals 4 as magnetic sealing members (magnet members) placed at end portions, respectively, of the developing sleeve 2 with respect to the axial direction of the developing sleeve 2 with a gap to an outer peripheral surface of the developing sleeve 2. Further, the developing device 104 includes magnetic plates 5 as magnetic members placed inside the magnetic sealing members 4, respectively, with respect to the axial direction of the developing sleeve 2 at the end portions with respect to the axial direction of the developing sleeve 2. Each of the magnetic plates 5 is disposed with a gap to the outer peripheral surface of the developing sleeve 2 and with a gap to the magnetic seal 4. Further, the developing device 104 includes a regulating blade as a developer regulating member for regulating the developer fed by the developing sleeve 2. Further, the developing device 104 includes first and second feeding screws 7*a* and 7*b* as developer feeding members for circulating the developer inside the developing container 1 by feeding the developer while stirring the developer inside the developing container 1.

In this embodiment, as the developer, a two-component developer T containing a non-magnetic toner t and a magnetic carrier c was used. The developing sleeve 2 incorporates the magnet roller 5 in a hollow portion thereof. The developing sleeve 2 is rotationally driven in an indicated arrow R3 direction (direction in which movement directions of the photosensitive drum 101 and the developing sleeve 2 are the same direction at an opposing portion to the photosensitive drum 101) in the figure. The developing sleeve 2 carries the developer (two-component developer in which the toner t is deposited on the surface of the carrier c) by a magnetic force of the magnet roller 5, and rotates, so that the developing sleeve 2 feeds the developer in the rotational direction R3 thereof and supplies the developer to the electrostatic latent image formed on the photosensitive drum 101. Further, the first and second feeding screws 7*a* and 7*b* are constituted by including helical screw blades on rotation shafts. The first and second feeding screws 7*a* and 7*b* feed the developer in axial directions thereof by rotational drive of their rotation shafts.

<Cross-Sectional Structure of Developing Device with Respect to Widthwise Direction>

The developing container 1 is provided with an opening 13 at a position corresponding to a developing portion (developing position) A where the developing container 1 opposes the photosensitive drum 1. The developing sleeve 2 is rotatably supported by the developing container 1 so that a part thereof is exposed toward the photosensitive drum 101 side at this opening 13. The magnet roller 3 incorporated in the hollow portion of the developing sleeve 2 is fixed to the developing container 1 so that the magnet roller 3 cannot rotate.

A flow of the developer in cross-section of the developing device 104 with respect to the widthwise direction of the developing device 104 will be described. First, with feeding of the developer by the first feeding screw 7*a*, the developer jumps and is supplied to the developing sleeve 2. In the developer, the magnetic carrier is mixed, and therefore, the developer is confined by a magnetic force generated by the magnet roller 3 in the developing sleeve 2. With rotation of the developing sleeve 2, the developer on the developing sleeve 2 passes through an opposing portion (regulating portion) between the developing sleeve 2 and the regulating blade 5 and is regulated in a proper amount (30 mg/cm$^2$ in this embodiment). The developer regulated in a proper amount is fed to the developing portion A opposing the photosensitive drum 101 with the rotation of the developing sleeve 2. The toner from the developer fed to the developing portion A is supplied to the electrostatic latent image on the photosensitive drum 101. The developer passed through the developing portion A is taken in the inside of the developing container 1 at a taking-in portion 14, and is collected by the second feeding screw 7*b*.

<Cross-Sectional Structure of Developing Device with Respect to Longitudinal Direction>

Inside the developing container 2, a partition wall 15 extending in a perpendicular direction to the drawing sheet surface of FIG. 2 is provided at a substantially central portion with respect to the perpendicular direction. As a result, the inside of the developing container 1 is partitioned into an upper developing chamber 11 with respect to the perpendicular direction and a lower stirring chamber 12 with respect to the perpendicular direction. The developer is accommodated in the developing chamber 11 and the stirring chamber 12.

In the developing chamber 11 and the stirring chamber 12, the first and second feeding screws 7*a* and 7*b* are disposed, respectively. The first feeding screw 7*a* is disposed at the bottom of the developing chamber 11 along the axial direction of the developing sleeve 2. The first feeding screw 7*a* supplies the developer to the developing sleeve 2 while feeding the developer in the developing chamber 11 along the axial direction (from a right-hand side toward a left-hand side) by being rotated. Further, the second feeding screw 7*b* is disposed at the bottom of the stirring chamber 12 along the axial direction of the developing sleeve 2. The second feeding screw 7*b* feeds the developer in an opposite direction to that by the first feeding screw 7*a* (from the left-hand side toward the right-hand side).

The developing chamber 11 and the stirring chamber 12 communicate with each other by a first connecting portion 16 and a second connecting portion 17 at end portions of the partition wall 15 with respect to the longitudinal direction of the developing device 104. The developer passed through the developing chamber 11 without being supplied from the developing chamber 11 to the developing sleeve 2 passes through the second connecting portion 17, and is dropped from the developing chamber 11 into the stirring chamber 12. Further, the developer collected from the developing sleeve in the stirring chamber 12 and the developer dropped from the developing chamber 11 are raised from the stirring chamber 12 into the developing chamber 11 through the first connecting portion 16. The developers are circulated between the developing chamber 11 and the stirring chamber 12 through the first and second connecting portions 16 and 17, which are communication portions at the end portions of the partition wall 15, by feeding of the developer by rotation of the first and second feeding screws 7*a* and 7*b*. Further, a toner in an amount corresponding to an amount of the toner consumed by the development is appropriately supplied from a hopper 140 into the stirring chamber 12.

A region where the electrostatic latent image is formable with respect to the axial direction of the photosensitive drum 1 is an image forming region. Further, a region corresponding to the image forming region on the photosensitive drum 101 with respect to the axial direction of the photosensitive drum 101 is a developing region X. That is, the developing region X is a region on the developer carrying member corresponding to the image forming region on the image bearing member for carrying the electrostatic latent image developed with the developer fed by the developing sleeve 2.

Incidentally, in this embodiment, the developing chamber 11 and the stirring chamber 12 are disposed vertically, but the present invention is also applicable to a developing device in which the developing chamber 11 and the stirring chamber 12 are horizontally disposed as has been widely used conventionally and developing devices having other forms.

<Developing Sleeve>

In this embodiment, the developing sleeve 2 is prepared by aluminum which is a non-magnetic material. In this embodiment, an outer diameter of the developing sleeve 2 is ϕ20 mm. Further, in this embodiment, as the developing sleeve 2, a grooved sleeve having a surface shape in which a plurality of recessed portions formed for ensuring a stable developer feeding property are disturbed was employed. The grooved sleeve is such that on an outer peripheral surface of the developing sleeve, grooves which include at least a component along the axial direction and which are arranged and disposed with predetermined intervals. In this embodiment, a plurality of lines of grooves 2*c* (FIG. 4) each extending in a direction substantially parallel to the axial direction of the developing sleeve 2 are formed with predetermined intervals with respect to a circumferential direction of the developing sleeve 2.

The grooved sleeve is excellent in durability since the grooved sleeve does not readily cause a lowering in developer feeding force with time compared with a blast sleeve having surface subjected to blasting. On the other hand, depending on a use mode, the grooved sleeve is liable to generate image density non-uniformity (banding) due to a period of grooved portions. Therefore, in this embodiment, with respect to the outer diameter of ϕ20 mm of the developing sleeve 2, the grooves were equidistantly disposed with respect to the circumferential direction of the developing sleeve 2 so that the grooves are V-shaped grooves (grooves each having a V-shaped cross-section perpendicular to the axial direction) and are 80 μm in groove depth and 80 lines in the number of the grooves. Further, a peripheral speed ratio of the developing sleeve 2 to the photosensitive drum 101 is 200% (a peripheral speed of the developing sleeve 2 is made faster than a peripheral speed of the photosensitive drum 101). As a result, a pitch corresponding to the grooves of the developing sleeve 2 on the image is made 0.5 mm or less, so that even when the banding generates, a banding region where it is difficult to discriminate the banding by visual observation is ensured.

In this embodiment, by employing the grooved sleeve, it became possible to obtain a stable feeding property. However, at each of the end portions of the developing sleeve 2 with respect to the axial direction of the developing sleeve 2, a developer feeding force equal to that in the developing region X is ensured, there is a liability that the developer laterally travels to the end portions each outside the developing region X and thus the developer leaks out of the developing container 1. Therefore, in this embodiment, the developing sleeve 2 was provided with a high feeding (power) region 2*a* in which the developing region X is included and the grooves 2*c* are formed on an outer peripheral surface of the developing sleeve 2 and with a low feeding (power) region 2*b* in which the developer feeding power is made lower than that in the high feeding region 2*a* at each of the end portions outside the developing region X. In this embodiment, the low feeding region 2*b* having no groove 2*c* on its surface was formed by cutting away the outer peripheral surface of the developing sleeve by 100 μm to narrow (decrease) the outer diameter, so that the developer feeding power was lowered.

Thus, in this embodiment, the outer peripheral surface of the developing sleeve 2 has a first region (high feeding region) 2*a* including the developing region X on the developing sleeve 2. Further, the outer peripheral surface of the developing sleeve 2 has a second region (low feeding region) 2*b* outside and adjacent to the first region 2*a* and having lower developer feeding power than in the first region 2*a* or having substantially no feeding power. Particularly, in this embodiment, the first region 2*a* includes the grooves 2*c* extending along the axial direction of the developing sleeve 2, and the second region 2*b* does not include the grooves 2*c*.

Incidentally, in this embodiment, the second region 2*b* does not include the grooves 2*c*, but may also include grooves each having a depth shallower than that of the grooves 2*c* in the first region 2*a* and extending along the axial direction of the developing sleeve 2, whereby the developer feeding power can also be made lower than that in the first region 2*a*. Further, in this embodiment, each groove 2*c* extends substantially parallel to the axial direction of the developing sleeve 2, but this groove 2*c* may only be required to extend along the axial direction of the developing sleeve 2, and may also have an angle (typically 45 degrees or less) with respect to the axial direction of the developing sleeve 2. Further, in this embodiment, as the developing sleeve 2, the grooved sleeve was employed, but the present invention is also applicable to a developing sleeve having another surface form, such as a blast sleeve.

<Magnet Roller>

Next, the magnet roller 3 will be described. Positions of magnetic poles provided in polarity along a circumferential direction of the magnet roller 3 are represented by a position of a peak magnetic flux density of a magnetic flux density distribution of a magnetic field formed by the respective magnetic poles. Further, the magnetic flux density of the magnetic field formed by the magnet roller 3 is a magnetic flux density at an outer peripheral surface of the magnet roller 3 with respect to a normal direction. Incidentally, also a position, with respect to the circumferential direction, on the developing sleeve 2 corresponding to the magnetic poles of the magnetic pole 3 is described as a position of the magnetic poles of the magnet roller 3 for convenience in some cases.

The magnet roller 3 which is a roller-shaped magnetic field generating means incorporated in the hollow portion of the developing sleeve 2 is fixedly disposed to the developing container 1. This magnet roller 3 has a plurality of magnetic poles fixedly disposed along the circumferential direction of the developing sleeve 2. In this embodiment, the magnet roller 3 has a developing magnetic pole S1 at a position opposing the developing portion A. By a magnetic field formed by the S1 pole at the developing portion A, the developer forms a magnetic brush on the developing sleeve 2. Further, this magnetic brush transfers the charged toner onto the electrostatic latent image on the photosensitive drum 101 by an electrostatic magnetic force while controlling the photosensitive drum 101 rotating in the arrow R1 direction in the figure, so that the electrostatic latent image is developed as the toner image. The magnet roller 3 has 5 poles in total consisting of an N1 pole, an N2 pole, an S2 pole and an S3 pole in addition to the above-described S1 pole.

Functions of the respective magnetic poles of the magnet roller 3 and a flow of the developer in a cross-section of the developing device 104 with respect to a widthwise direction of the developing device 104 will be described. First, with the feeding of the developer by the first feeding screw 7*a*, the developer jumps and is supplied to the developing sleeve 2. Thereafter, the developer passes through the position of the S2 pole opposing the regulating blade 6 with the rotation of the developing sleeve 2 and is regulated in a proper amount (30 mg/cm$^2$ in this embodiment). The developer regulated in the proper amount passes through the position of the N1 pole and is supplied to the position of the S1 pole opposing the photosensitive drum 101. Thereafter, the developer which passed through the developing portion A and which consumed the toner on the electrostatic latent image passes through the position of the N2 pole and is carried to the position of the S3 pole, so that the developer is taken inside the developing container 1. A portion where the developer passed through the developing portion A is taken inside the developing container 1 is the taking-in portion 14. Thereafter, the developer is scraped off and dropped from the surface of the developing sleeve 2 by a repelling magnetic field generated between the S3 pole and the S2 pole which are a pair of repelling magnetic poles which have the same polarity and which are adjacent to each other, and is collected by the second feeding screw 3*b*.

<End Portion Sealing Structure of Developing Sleeve>

Figure 4:
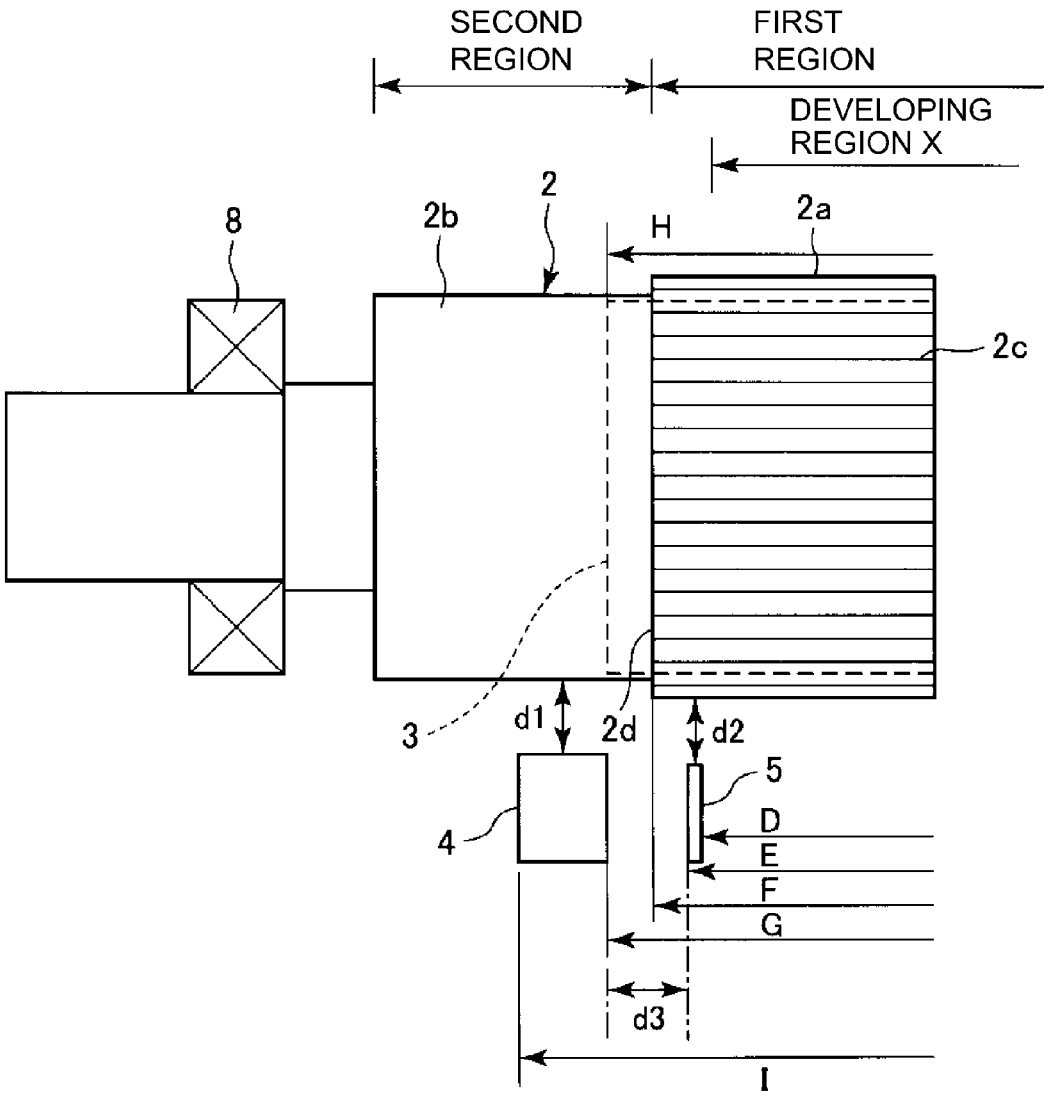
FIG. 4 is a schematic view of an end portion sealing structure of a developing sleeve.

FIG. 4 is a schematic view of an end portion sealing structure of the developing sleeve 2 in this embodiment. Incidentally, FIG. 4 shows only one end portion of the developing sleeve 2 with respect to the axial direction of the developing sleeve 2, but another end portion is similar (symmetrical on the basis of a center with respect to the axial direction of the developing sleeve 2) to the one end portion.

The developing sleeve 2 is supported rotatably by the developing container 1 through bearings 8 provided at end portions thereof with respect to the axial direction. With respect to the axial direction of the developing sleeve 2, magnetic seals 4 are placed inside the bearings 8. Further, with respect to the axial direction of the developing sleeve 2, magnetic plates 5 are placed inside the magnetic seals 4.

The magnetic seal 4 and the magnetic plate 5 are disposed adjacent to each other in a non-control state along the axial direction of the developing sleeve 2. Further, magnetic lines of force extend between the magnet roller 3 inside the developing sleeve 2 and at least one of the magnetic seal 4 and the magnetic plate 5, so that a magnetic chain by the developer is formed. This magnetic chain is densely formed in a gap between the developing sleeve 2 and the magnetic seal 4 and/or the magnetic plate 5, so that a function as an end portion seal is achieved. As a result, the action of blocking the developer moved from the developing container 1 along the surface of the developing sleeve by reciprocating circulation in the developing container 1 is achieved. Further, the action of blocking flowing-out of the toner, to an outside of the developing container 1, scattered from the two-component developer circulating inside the developing container 1 is achieved.

Figure 5:
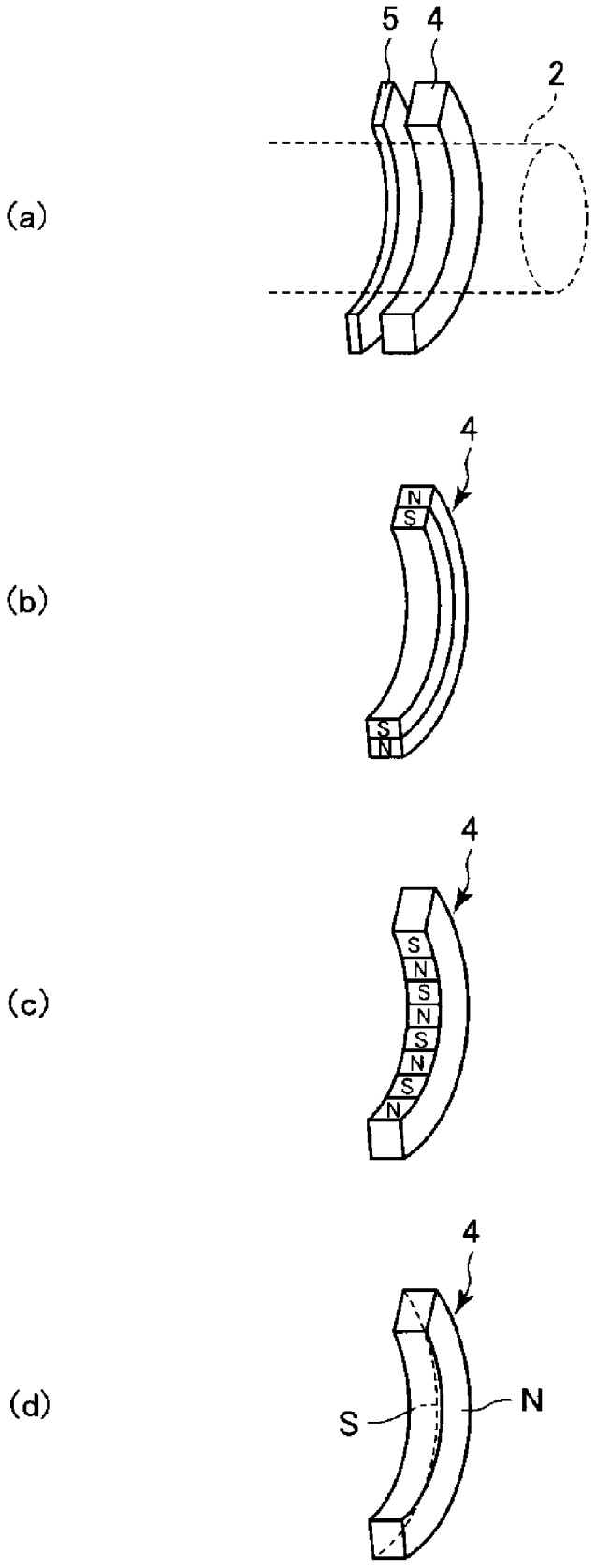
FIG. 5 includes schematic views of magnetic seals and magnetic plates.

As shown in (a) of FIG. 5, each of the magnetic seal 4 and the magnetic plate 5 extends in an arcuate shape so as to oppose a predetermined range of the developing sleeve 2 with respect to the circumferential direction of the developing sleeve 2 with a certain gap to the outer peripheral surface of the developing sleeve 2 at the end portion with respect to the axial direction of the developing sleeve 2. Each of the magnetic seal 4 and the magnetic plate 5 is mounted to the developing container 1 in this state. The magnetic seal 4 is a magnetic resin member which includes, as a constituent element, a magnet including a nylon binder containing magnetic powder of Nd—Fe—B and which has a predetermined width (length with respect to a longitudinal direction of the developing device) and a predetermined thickness (length with respect to a widthwise direction of the developing device) and which is prepared by injection molding. The magnetic plate 5 is an iron-made metal plate having a predetermined thickness (length with respect to the longitudinal direction of the developing device 104) and a predetermined width (length with respect to the widthwise direction of the developing device 104). The magnetic seal 4 may be magnetized in magnetic pole patterns as shown in (b) to (d) of FIG. 5, for example. In the case of (b) of FIG. 5, a surface opposing the developing sleeve 2 and an opposite surface from the surface are magnetized to different polarities from each other. In the case of (c) of FIG. 5, the magnetic poles are magnetized alternately to the different polarities along the circumferential direction of the developing sleeve 2. In the case of (d) of FIG. 5, with respect to the axial direction of the developing sleeve 2, one surface and another surface are magnetized to the different polarities. Particularly, in this embodiment, as the magnetic seal 4, one magnetized as shown in (d) of FIG. 5 was used (specifically see FIG. 2). In this embodiment, as the magnetic seal 4, one having a magnetic flux density of 600 G (Gause) was used. This magnetic flux density is a peak magnetic flux density of the magnetic flux density of the magnetic seal 4 with respect to the normal direction at the surface in the developing sleeve 2 side.

Incidentally, with respect to a radial direction (widthwise direction of the developing device 104) of the developing sleeve 2, when a distance d1 between the surface of the magnetic seal 4 opposing the developing sleeve 2 and the outer surface of the developing sleeve 2 and a distance d2 between the surface of the magnetic plate 5 opposing the developing sleeve 2 and the outer surface of the developing sleeve 2 is made gradually small, there is a tendency that the above-described sealing function enhances. However, when these distances d1 and d2 are made excessively small, developer pressure increases and thus the developer deteriorates due to sliding with the developing sleeve 2, so that the toner fuses at the surface of the developing sleeve 2 and toner agglomerate generates in some cases. On the other hand, when these distances d1 and d2 are made excessively large, a magnetic sealing property loses. For that reason, in this embodiment, by comparing and studying the above-described respective factors, each of these distances d1 and d2 was set at 1.0 mm.

Further, when a distance d3 between the magnetic seal 4 and the magnetic plate 5 with respect to the axial direction of the developing sleeve 2 is made gradually small, there is a tendency that the above-described sealing function enhances. However, when this distance d3 is made excessively near (small), a magnetic force of constraint is excessively strong, and therefore the developer continuously stagnates. Thus, the toner fuses at the surface of the developing sleeve 2 and the toner agglomerate generate due to deterioration of the developer by the sliding with the developing sleeve 2 in some cases. On the other hand, when this distance d3 is made excessively large, the magnetic sealing property loses. For that reason, in this embodiment, by comparing and studying the above-described respective factors, this distance d3 was set at 1.5 mm. As in this embodiment, this distance d3 is typically set at a value larger than the above-described distances d1 and d2.

Further, the boundary 2*d* between the first region (high feeding region) 2*a* and the second region (low feeding region) 2*b* on the outer peripheral surface of the developing sleeve 2 at each of the end portions with respect to the axial direction of the developing sleeve 2 positions between the magnetic seal 4 and the magnetic plate 5 with respect to the axial direction of the developing sleeve 2. In the following, this point will be described specifically.

Here, in FIG. 4, a distance between an inside and an inside of the magnetic plates 5 at the end portions with respect to the axial direction of the developing sleeve 2 ("magnetic plate (inside-inside) distance") is D. Further, a distance between an outside and an outside of the magnetic plates 5 at the end portions with respect to the axial direction of the developing sleeve 2 ("magnetic plate (outside-outside) distance") is E. Further, a length of the high feeding region 2*a* with respect to the axial direction of the developing sleeve 2 ("high feeding region distance") is F. Further, a distance between the magnetic seal 4 at the end portions with respect to the axial direction of the developing sleeve 2 ("seal (inside-inside) distance") is G. Further, a length of the magnet roller 3 with respect to the axial direction of the developing sleeve 2 ("magnet roller length") is H. Further, a distance between an outside and an outside of the magnetic seal 4 at the end portions with respect to the axial direction of the developing sleeve 2 ("seal (outside-outside) distance") is I. These length regions are arranged on the basis of a center of the developing sleeve 2, and therefore, a shorter length region is disposed in an inner side.

When an end portion of the high feeding region 2*a* of the developing sleeve 2 is disposed inside the magnetic plate 5 with respect to the axial direction of the developing sleeve 2, at the taking-in portion 14, the developer stagnates between the magnetic plate 5 and the magnetic seal 4 in some cases. By this, the developer is not taken inside the developing container 1, so that the "developer dropping" as described above is caused in some cases. This is because the developer feeding power of the developing sleeve 2 at this portion is excessively low. On the other hand, when the high feeding region 2*a* of the developing sleeve 2 extended to a place where the high feeding region 2*a* overlaps with the magnetic seal 4 with respect to the axial direction of the developing sleeve 2, the following phenomenon occurs. That is, although the stagnation of the developer is suppressed, the developer magnetically confined by the magnetic seal 4 deteriorates by the sliding with the developing sleeve 2 in some cases. By this, the toner in the two-component developer is liberated and causes the "toner dropping" as described above in some cases. This is because the toner feeding power at this portion is excessively high.

Therefore, in this embodiment, a positional among the high feeding region 2*a* of the developing sleeve 2, the low feeding region 2*b* of the developing sleeve 2, the magnetic seal 4 and the magnetic plate 5 with respect to the axial direction of the developing sleeve 2 is the following relation as shown in FIG. 4.

Magnetic plate (outside-outside) distance $E$<High feeding region distance $F$<Seal (inside-inside) distance $G$ As a result of this, the developing sleeve 2 has a relatively large developer feeding force between the magnetic seal 4 and the magnetic plate 5, and therefore the developer does not readily stagnate. Further, in an overlapping region with the magnetic seal 4, the developer feeding force of the developing sleeve 2 is small and therefore the deterioration of the developer does not readily generate.

Further, in this embodiment, in order to ensure the feeding force in an entire region of the high feeding region 2*a* of the developing sleeve 2, the magnet roller L H is made longer than the high feeding region length F. That is, in this embodiment, each of the end portions of the plurality of magnetic poles of the magnet roller 3 with respect to the axial direction of the developing sleeve 2 positions outside the boundary 2*d* between the first region 2*a* and the second region 2*b* on the outer peripheral surface of the developing sleeve 2 with respect to the axial direction of the developing sleeve 2. Incidentally, in order to suppress attraction of the developer to an outside of the end portion sealing portion formed by the magnetic seal 4 and the magnetic plate 5 by the magnetic force of constraint of the magnet roller 3, the magnet roller length H is shorter than the seal (outside-outside) distance I.

In this embodiment, in order to satisfy the above-described relation also in consideration of part tolerance, relative to a length of 326 mm of the developing region X with respect to the axial direction of the developing sleeve 2, lengths of the respective regions were set as follows.

Magnetic plate (inside-inside) distance D: 326.2 mm±0.2 mm

Magnetic plate (outside-outside) distance E: 327.2 mm±0.2 mm

High feeding region length F: 329±0.4 mm

Magnet seal (inside-inside) distance G: 330.2±0.2 mm

Magnet roller length H: 330.6±6 mm

According to this embodiment, by employing the above-described constitution, in the case where the magnetic sealing member is used, in conveniences such as stagnation of the developer at the developer taking-in portion, and deterioration of the developer due to the sliding of the developer with the developer carrying member can be suppressed. For that reason, according to this embodiment, a good sealing property can be achieved at the end portions of the developing sleeve 2 without generating evil effects such as the developer dropping and the toner dropping.

Embodiment 2

Next, another embodiment of the present invention will be described. Basic structures and operations of a developing device, a process cartridge and an image forming apparatus in this embodiment are the same as those in Embodiment 1. Accordingly, elements having functions and structures identical or corresponding to those in Embodiment 1 will be omitted from detailed description by adding the same reference numerals or symbols.

In this embodiment, in addition to the constitution of Embodiment 1, relative to magnetic flux densities, polarities and pole arrangement positions of the repelling magnetic poles S2 and S3 of the magnet roller 3, a magnetic flux density, a polarity and a position surrounding a periphery of the developing sleeve with respect to a circumferential direction of the magnetic seal 4 will be specifically defined. Further, in this embodiment, in addition to the constitution of Embodiment 1, relative to magnetic flux densities, polarities and pole arrangement positions of the repelling magnetic poles S2 and S3 of the magnet roller 3, a position surrounding a periphery of the developing sleeve with respect to a circumferential direction of the magnetic plate 4 will be specifically defined. By this, the effect described in Embodiment 1 can be more satisfactorily obtained.

Figure 6:
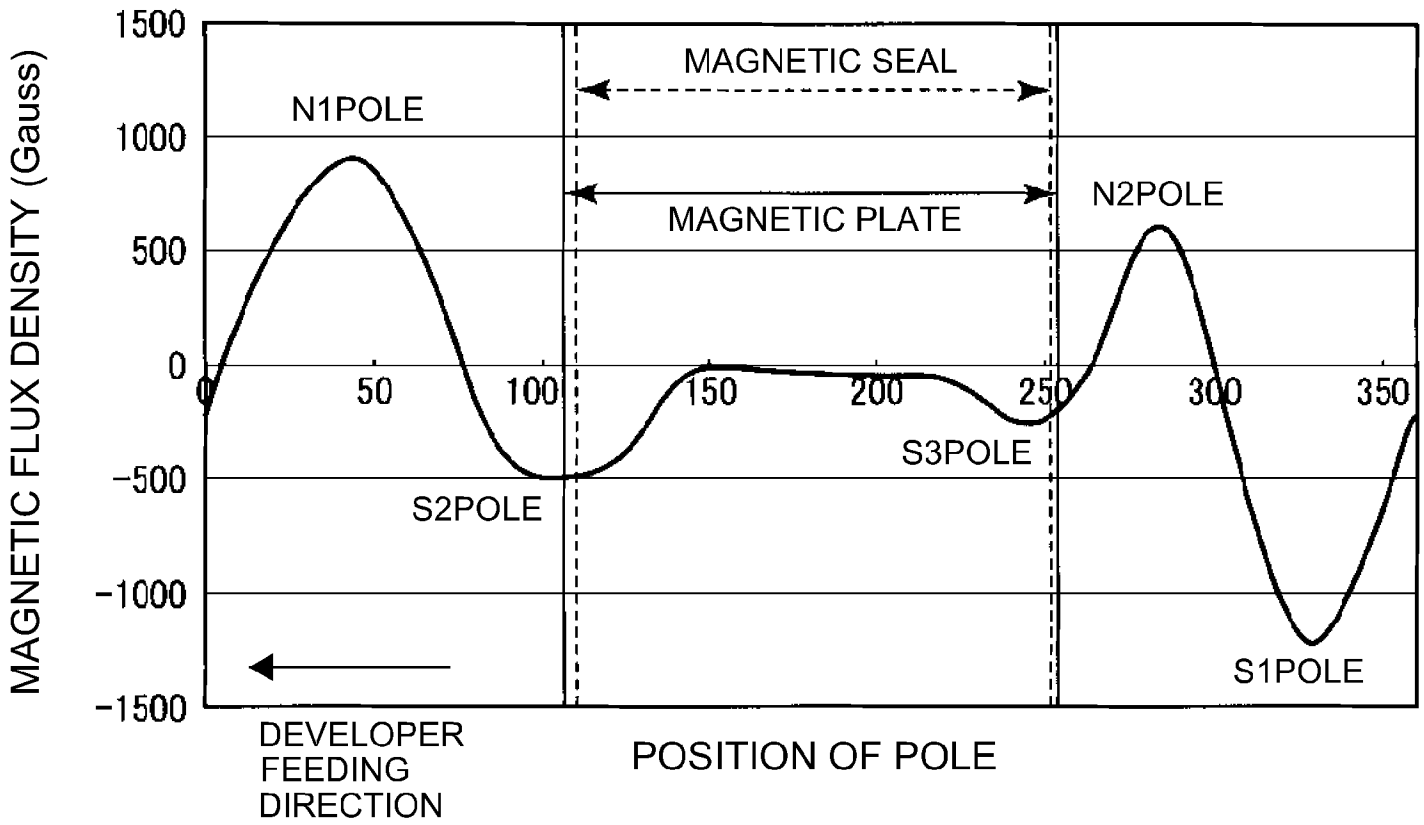
FIG. 6 is a graph chart for illustrating a magnetic flux density distribution of a magnet roller with respect to a circumferential direction of the developing sleeve and an arrangement of the magnetic seal and the magnetic sealing member.

FIG. 6 shows a magnetic flux density distribution with respect to the circumferential direction of the magnet roller 3. Incidentally, in FIG. 6, the magnetic flux density is plotted clockwisely with a 0°-position as a horizontal position of the developing sleeve 2 in the photosensitive drum 101 side. Further, an area between vertical solid lines in FIG. 6 shows an arrangement position of the magnetic plate 5 with respect to the circumferential direction of the developing sleeve 2. Further, an area between vertical broken lines in FIG. 6 shows an arrangement position of the magnetic seal 4 with respect to the circumferential direction of the developing sleeve 2.

First, the magnetic seal 4 may preferably extend, with respect to the circumferential direction of the developing sleeve 2, to a range in which at least a repelling magnetic field region formed by the S2 pole and the S3 pole of the magnet roller 3 is included in an inside thereof. The repelling magnetic field region is formed between the repelling magnetic poles S2 and S3 and is a region where the magnetic flux density is lower than each of the magnetic poles consisting of the repelling magnetic poles S2 and S3. Further, the magnetic plate 5 may preferably extend, with respect to the circumferential direction of the developing sleeve 2, to a range in which at least the magnetic seal 4 is included in an inside thereof.

In this embodiment, specifically, the magnetic seal 4 is disposed so as to surround the developing sleeve 2 from a 110°-position to a 252°-position with respect to the circumferential direction of the developing sleeve 2. Further, the magnetic plate 5 is disposed so as to surround the developing sleeve 2 from a 106°-position to a 254°-position with respect to the circumferential direction of the developing sleeve 2. Incidentally, each of the magnetic seal 4 and the magnetic plate 5 does not extend to outside of a position where the magnetic flux density lowers to the extent that the magnetic flux density is the same as that in the repelling magnetic field region in a side outside the S2 pole and the S3 pole.

That is, with respect to the axial direction of the developing sleeve 2, in order to magnetically seal the developer in an inner side, the magnetic plate 5 may preferably extend to a range including the magnetic seal 4 inside with respect to the circumferential direction of the developing sleeve 2. In the case where the magnetic seal 4 is disposed to an outside of the magnetic plate 5 with respect to the circumferential direction of the developing sleeve 2, at a position where the magnetic seal 4 protrudes from the magnetic plate 5, magnetic regulation by the magnetic plate 5 is not made. For that reason, at that position, the developer on the developing sleeve 2 is attracted in a large amount toward the outside of the developing sleeve 2 with respect to the axial direction of the developing sleeve 2 to the position of the magnetic seal 4. The developer in the large amount attracted to the magnetic seal 4 tends to stagnate in the gap between the developing sleeve 2 and the magnetic seal 4. By this, based on the above-described mechanism, the "developer dropping" is generated in some cases.

Incidentally, from the above-described reason, the magnetic seal 4 may preferably be included inside the magnetic plate 5 with respect to the circumferential direction of the developing sleeve 2, but when the length of the magnetic seal 4 with respect to the circumferential direction is excessively short, the magnetic regulation by the magnetic plate 5 is now weak and is undesirable. A free end portion of the magnetic plate 5 is magnetized by not only a magnetic field generated from the magnet roller 3 but also a magnetic field of the magnetic seal 4 close to the magnet roller 3, so that a good magnetic sealing property at this position can be ensured. For that reason, the lengths of the magnetic seal 4 and the magnetic plate 5 with respect to the circumferential direction may desirably be desired so that these members are brought near to each other to the extent that the magnetic seal 4 does not protrude by a design tolerance.

Here, as described above, it is desirable that magnetic sealing is made at the position of the magnetic plate 5 with respect to the axial direction of the developing sleeve 2. From this viewpoint, the magnetization is made by concentrating the magnetic field at the free end portion of the magnetic plate 5. For that reason, for example, it would be considered that a method in which a degree of the magnetization with the magnetic plate 5 is enhanced by increasing the magnetic flux density of the S3 pole of the magnet roller 3 is used. However, in this method, magnetic constraint between the S3 pole and the magnetic seal 4 is also strengthened at the same time, and therefore there is a liability that the developer is attracted to the magnetic seal 4. Further, it would be considered that a method such that the magnetic flux density is kept at a high level to the position of the magnetic plate 5 and is weakened at the position of the magnetic seal 4 by controlling the magnetic flux density of the S3 pole with respect to the axial direction of the developing sleeve 2 is used. By this, it is possible to suppress the attraction of the developer to the magnetic seal 4, but in this method, it is difficult to control a magnetic force distribution of the magnet roller with accuracy.

Therefore, in this embodiment, at the surface of the magnetic seal 4 opposing the developing sleeve 2, the magnetic poles having the same polarity as the deteriorate magnetic poles S2 and S3 of the magnet roller 3 are disposed ((b) of FIG. 5). Further, the magnetic flux density at the surface of the magnetic seal 4 opposing the developing sleeve 2 is made larger than the magnetic flux density of each of the magnetic poles consisting of the repelling magnetic poles S2 and S3. Further, a distance between the magnetic seal 4 and the magnetic plate 5 with respect to the axial direction of the developing sleeve is made smaller than the distance d4 between the magnet roller 3 and the magnetic plate 5 with respect to the radial direction of the developing sleeve 2. In the following, the reason why such a constitution is preferred will be described.

Figure 7:
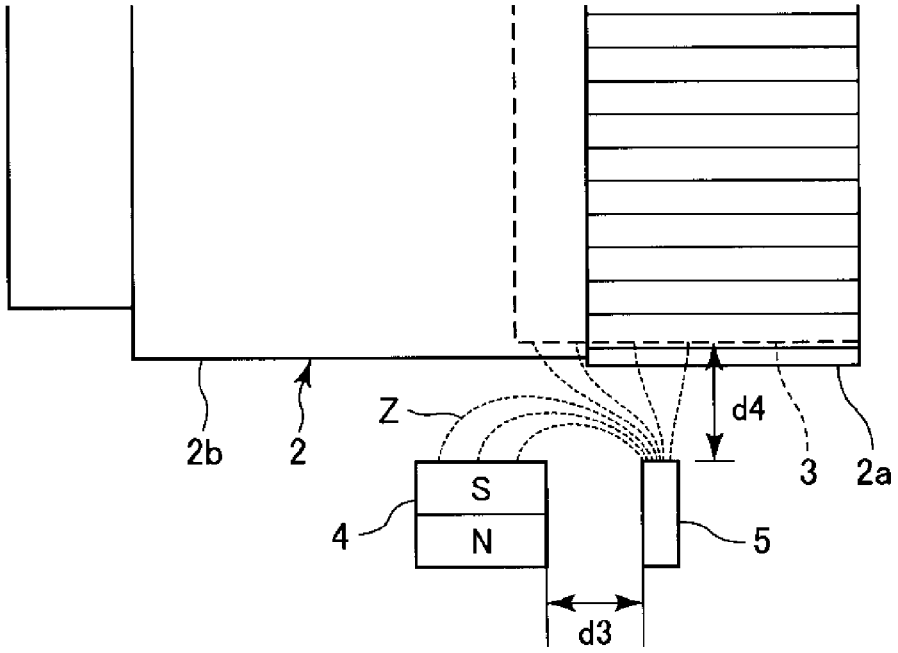
FIG. 7 is a schematic view showing magnetic lines of force among a magnetic plate, a magnetic seal and a magnet roller in an embodiment.
Figure 8:
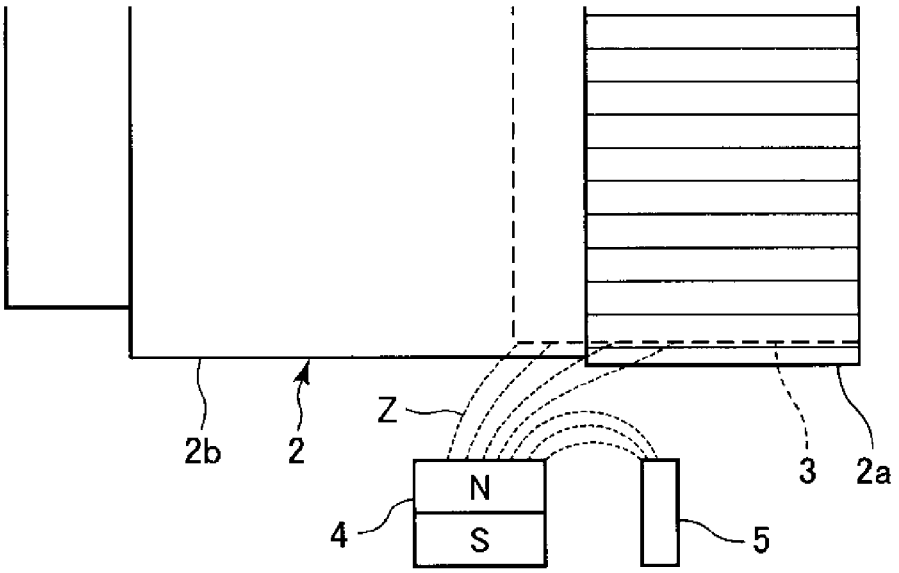
FIG. 8 is a schematic view showing magnetic lines of force among a magnetic plate, a magnetic seal and a magnet roller in a comparison example.

FIG. 7 is a schematic view showing magnetic lines of force of the magnetic plate 5, the magnetic seal 4 and the magnet roller 3 in the end portion sealing structure of the developing sleeve 2 in this embodiment. FIG. 7 particularly shows the neighborhood of the taking-in portion 14 with respect to the circumferential direction of the developing sleeve 2. In this embodiment, the magnetic pole of the surface of the magnetic seal 4 in the side opposing the developing sleeve 2 and the S3 pole have the same polarity. By this, a repelling magnetic field is formed between the S3 pole and the magnetic seal 4, and therefore magnetic lines Z of force are liable to concentrate at the magnetic plate 5 side. On the other hand, FIG. 8 is a schematic view showing magnetic lines of force in the case where the magnetic pole of the surface of the magnetic seal 4 in the side opposing the developing sleeve 2 and the S3 pole have the different polarities. In this case, the magnetic lines Z of force concentrate between the magnetic seal 4 and the S3 pole, so that the magnetic sealing portion of the developer positions in a most end portion side with respect to the axial direction of the developing sleeve 2 is undesirable.

Further, in this embodiment, the magnetic flux density of the surface of the magnetic seal 4 in the side opposing the developing sleeve 2 is set at 600 G, and the magnetic flux density of the S3 pole is set at 250 G weaker than 600 G. Further, in this embodiment, the magnetic seal 4 is disposed closer to the magnetic plate 5 than the S3 pole is. That is, in this embodiment, an outer diameter of the magnet roller 3 is 17.7 mm, and the distance d4 between an outer peripheral position of the magnet roller 3 and a free end of the magnetic plate 5 with respect to the radial direction of the developing sleeve 2 is 1.85 mm. Incidentally, the outer peripheral position of the magnet roller 3 and an outer peripheral position of the S3 pole can be regarded as being the same. On the other hand, the distance d3 between the magnetic seal 4 and the magnetic plate 5 with respect to the axial direction of the magnetic plate 5 with respect to the axial direction of the developing sleeve is 1.5 mm. For that reason, the magnetic plate 5 tends to be magnetized so as to follow the magnetic pole of the magnetic seal 4 having the higher magnetic flux density, so that the free end side of the magnetic plate 5 is magnetized to an N pole opposite in polarity from that of the surface of the magnetic seal 4 in the side opposing the developing sleeve 2, so that a magnetic circuit with the S3 pole tends to be formed strongly. That is, the magnetic sealing property at the free end portion of the magnetic plate 5 is enhanced, and therefore it is possible to ensure a good magnetic sealing property at this position.

Incidentally, an effect by formation of the above-described repelling magnetic field by making the magnetic pole of the surface of the magnetic seal 4 in the side opposing the developing sleeve 2 and the S3 pole the magnetic poles having the same polarity can be sufficiently obtained if the magnetic flux density of that surface of the magnetic seal 4 is a magnetic flux density not less than a half-value width region of the magnetic flux density of the S3 pole. Further, in this embodiment, the taking-in portion 14 side of the developer into the developing container 1 was described as an example, and therefore, the magnetic circuit at the periphery of the S3 pole was described, but in the above-described mechanism, the developer feeding direction (component) does not contribute to the effect. For that reason, based on exactly the same mechanism, a similar effect can be obtained also at the periphery of the S2 pole. In this embodiment, compared with the magnetic flux density of 600 G at the surface of the magnetic seal 4 in the side opposing the developing sleeve 2, the magnetic flux density of the S2 pole is set at 500 G smaller than 600 G. In other words, the magnetic seal 4 has the magnetic poles having the same polarity as the repelling magnetic poles S2 and S3 at its surface opposing a region where the magnetic flux density is half of the peak magnetic flux density of each of the magnetic poles consisting of the repelling magnetic poles S2 and S3.

According to this embodiment, by move specifically defining the arrangement or the like of the magnetic seal 4 and the magnetic plate 5, the effect described in Embodiment 1 can be obtained more satisfactorily.

Others

As described above, the present invention was described in accordance with specific embodiments, but the present invention is not limited to the above-described embodiments.

In the above-described embodiments, the case where the developer was the two-component developer was described, but the present invention is also applicable to the case where the developer is a magnetic position component developer, so that an effect similar to those in the above-described embodiments can be obtained.

Further, in the above-described embodiments, the developing device is incorporated in the process cartridge and is detachably mountable to the apparatus main assembly of the image forming apparatus, but the present invention is not limited to the embodiments. In the case where the developing device is detachably mountable alone to the apparatus main assembly, even in the case where the developing device is mounted in the apparatus main assembly so that the developing device cannot be readily mounted and demounted, the present invention is applicable, so that an effect similar to those in the above-described embodiments.

INDUSTRIAL APPLICABILITY

According to the present invention, a developing device, a process cartridge and an image forming apparatus which are capable of suppressing in conveniences such as stagnation of the developer at the develop taking-in portion and deterioration of the developer due to sliding of the developer with the developer carrying member in the case where the magnetic sealing member is used are provided.

EXPLANATION OF SYMBOLS

1 Developing container
2 Developing sleeve
3 Magnet roller
4 Magnet seal
5 Magnetic plate
100 Image forming apparatus
104 Developing device
110 Process cartridge

The invention claimed is:

1. A developing device comprising:

a developing container configured to accommodate a developer;

a rotatable developer carrying member configured to carry the developer;

a magnetic field generator provided inside said developer carrying member and configured to generate a magnetic field;

magnetic members configured to be magnetized by an ambient magnetic field, wherein said magnetic members are provided at respective end portions of said developer carrying member with respect to an axial direction of said developer carrying member with a gap to an outer peripheral surface of said developer carrying member; and magnet members configured to generate a magnetic field, wherein said magnet members are provided at the respective end portions with respect to the axial direction of said developer carrying member, and wherein with respect to the axial direction of said developer carrying member, said magnet members are provided outside said magnetic members and are provided opposed to said magnetic members with gaps to said magnetic members so as to magnetize said magnetic members, wherein with respect to the axial direction of said developer carrying member, the outer peripheral surface of said developer carrying member includes a first region including a developing region corresponding to an image forming region and a second region outside and adjacent to the first region and having lower developer feeding power than in the first region or having substantially no feeding power, and wherein with respect to the axial direction of said developer carrying member, the first region is larger than a region between outside surfaces of said magnetic members and is smaller than a region between inside surfaces of said magnet members.

2. A developing device according to claim 1, wherein a boundary between the first region and the second region at each of the end portions of said developer carrying member with respect to the axial direction is provided so as to be positioned outside the region sandwiched by the outside surfaces of said magnetic members and inside the region sandwiched by the inside surfaces of said magnet members.

3. A developing device according to claim 1, wherein each of the end portions of said magnetic field generator with respect to the axial direction of said developer carrying member is positioned outside a boundary between the first region and the second region of the outer peripheral surface of said developer carrying member with respect to the axial direction of said developer carrying member.

4. A developing device according to claim 1, wherein the first region of the outer peripheral surface of said developer carrying member has grooves along the axial direction of said developer carrying member, and the second region of the outer peripheral surface of the developer carrying member has grooves shallower in depth than the grooves of the first region.

5. A developing device according to claim 1, wherein said magnetic field generator includes a plurality of magnetic poles fixedly provided along a circumferential direction of said developer carrying member and including a pair of repelling magnetic poles which have the same polarity and which are adjacent to each other, wherein with respect to the circumferential direction of said developer carrying member, said magnet member extends in a range in which a region formed between the pair of repelling magnetic poles and having a lower magnetic flux density than each of magnetic poles of the pair of repelling magnetic poles is included, wherein with respect to the circumferential direction of said developer carrying member, said magnetic member extends in a range in which said magnet member is included, and wherein said magnet member includes a magnetic pole having the same polarity as the pair of repelling magnetic poles at a surface opposing said magnetic field generator.

6. A developing device according to claim 5, wherein with respect to the circumferential direction of said developer carrying member, said magnet member includes a magnetic pole having the same polarity as the pair of repelling magnetic poles at a surface opposing at least a region of said magnetic field generator where a magnetic flux density thereof is half of a peak magnetic flux density of each of the magnetic poles of the pair of repelling magnetic poles.

7. A developing device according to claim 5, wherein said magnet member has a magnetic flux density larger than a magnetic flux density of each of the magnetic poles of the pair of repelling magnetic poles at a surface opposing each of the magnetic poles of the pair of repelling magnetic poles.

8. A developing device according to claim 1, wherein a distance d3 between a surface of said magnet member opposing said developer carrying member and the outside surface of said magnetic member with respect to the axial direction of said developer carrying member is larger than a distance d1 between the surface of said magnet member opposing said developer carrying member and the outer peripheral surface of said developer carrying member with respect to a radial direction of said developer carrying member and a distance d2 between an inner surface of said magnetic member and an outer surface of said developer carrying member with respect to the radial direction of said developer carrying member.

9. A developing device comprising:

a developing container configured to accommodate a developer;

a rotatable developer carrying member configured to carry the developer, wherein the developer carrying member includes a first region in which grooves for carrying the developer are provided and a second region in which the grooves are not provided;

a magnetic field generating portion provided inside said developer carrying member and configured to generate a magnetic field;

magnetic members provided at respective end portions of said developer carrying member with respect to an axial direction of said developer carrying member with a gap to an outer peripheral surface of said developer carrying member, wherein each magnetic member opposes the first region; and magnet members provided at the respective end portions with respect to the axial direction of said developer carrying member, and wherein with respect to the axial direction of said developer carrying member, each magnet member is provided outside each magnetic member and is provided opposed to each magnetic member with a gap to each magnetic member, wherein each magnet member opposes the second region, and wherein with respect to the axial direction of said developer carrying member, the first region is larger than a region between outside surfaces of said magnetic members and is smaller than a region between inside surfaces of said magnet members.

10. A developing device according to claim 9, wherein the second region is in a position adjacent to the first region.

11. A developing device according to claim 9, wherein the grooves are provided along the axial direction of said developer carrying member over the first region.

12. A developing device according to claim 9, wherein with respect to the axial direction of said developer carrying member, each of the end portions of said magnetic field generating portion is positioned outside the associated end of the first region.

13. A developing device according to claim 9, wherein with respect to the axial direction of said developer carrying member, each magnet member is in a position corresponding to a position outside the associated end of said magnetic field generating portion.

14. A developing device according to claim 9, wherein said magnetic field generating portion includes adjacent magnetic poles which have the same polarity, and wherein said magnet member opposing said developer carrying member has a magnetic pole having the same polarity as the polarity of the adjacent magnetic poles of said magnetic field generating portion.

15. A developing device according to claim 9, wherein said magnetic field generating portion includes magnetic poles which have the same polarity and which are adjacent to each other, and wherein each said magnetic member is provided so as to oppose a region between the magnetic poles which have the same polarity and which are adjacent to each other with respect to a rotational direction of said developer carrying member.

16. A developing device according to claim 11, wherein said magnetic field generating portion includes magnetic poles which have the same polarity and which are adjacent to each other, and wherein each said magnet member is provided so as to oppose a region between the magnetic poles which have the same polarity and which are adjacent to each other with respect to a rotational direction of said developer carrying member.

17. A developing device comprising:

a developing container configured to accommodate a developer;

a rotatable developer carrying member configured to carry the developer, wherein said developer carrying member includes a first region in which grooves for carrying the developer are provided and a second region in which the grooves are not provided;

a magnetic field generating portion provided inside said developer carrying member and configured to generate a magnetic field;

magnetic members provided at respective end portions of said developer carrying member with respect to an axial direction of said developer carrying member with a gap to an outer peripheral surface of said developer carrying member, wherein each magnetic member opposes the first region of said developer carrying member at a positon spaced from a position corresponding to an associated end of the first region toward a position corresponding to a central side of said developer carrying member by a predetermined amount with respect to the axial direction of said developer carrying member; and magnet members provided at the respective end portions with respect to the axial direction of said developer carrying member, and wherein with respect to the axial direction of said developer carrying member, each magnet member is provided outside each magnetic member and is provided opposed to each magnetic member with a gap to each magnetic member, wherein each magnet member opposes the second region of said developer carrying member at a positon spaced from a position corresponding to an associated inner end of the second region toward a position corresponding to an outer end side of said developer carrying member by a predetermined amount with respect to the axial direction of said developer carrying member.

18. A developing device according to claim 17, wherein the second region is in a position adjacent to the first region.

19. A developing device according to claim 17, wherein the grooves are provided along the axial direction of said developer carrying member over the first region.

20. A developing device according to claim 17, wherein with respect to the axial direction of said developer carrying member, each of the end portions of said magnetic field generating portion is positioned outside the associated end of the first region.

21. A developing device according to claim 17, wherein with respect to the axial direction of said developer carrying member, each magnet member is in a position corresponding to a position outside the associated end of said magnetic field generating portion.

22. A developing device according to claim 17, wherein said magnetic field generating portion includes adjacent magnetic poles which have the same polarity, and wherein said magnet member opposing said developer carrying member has a magnetic pole having the same polarity as the polarity of the adjacent magnetic poles of said magnetic field generating portion.

23. A developing device according to claim 17, wherein said magnetic field generating portion includes magnetic poles which have the same polarity and which are adjacent to each other, and wherein each said magnetic member is provided so as to oppose a region between the magnetic poles which have the same polarity and which are adjacent to each other with respect to a rotational direction of said developer carrying member.

24. A developing device according to claim 19, wherein said magnetic field generating portion includes magnetic poles which have the same polarity and which are adjacent to each other, and wherein each said magnet member is provided so as to oppose a region between the magnetic poles which have the same polarity and which are adjacent to each other with respect to a rotational direction of said developer carrying member.

* * * * *